US007370369B2

(12) United States Patent
Cheung

(10) Patent No.: US 7,370,369 B2
(45) Date of Patent: May 13, 2008

(54) SANITARY ARM SLEEVE STRUCTURE

(76) Inventor: Ken Cheung, 15583 Oak Springs Rd., Chino Hills, CA (US) 91709

( * ) Notice: Subject to any disclaimer, the term of this patent is extended or adjusted under 35 U.S.C. 154(b) by 814 days.

(21) Appl. No.: 10/667,038

(22) Filed: Sep. 22, 2003

(65) Prior Publication Data

US 2005/0061331 A1 Mar. 24, 2005

(51) Int. Cl.
*A41D 27/12* (2006.01)
*A41B 9/00* (2006.01)

(52) U.S. Cl. ..... 2/59; 2/114

(58) Field of Classification Search ..... 2/16, 2/59, 125, 168, 123, 270
See application file for complete search history.

(56) References Cited

U.S. PATENT DOCUMENTS

| | | | | | |
|---|---|---|---|---|---|
| 931,711 | A * | 8/1909 | Hochstuhl | 2/270 |
| 954,311 | A * | 4/1910 | Leiner | 2/270 |
| 1,784,285 | A * | 12/1930 | Heaton | 2/270 |
| 2,543,317 | A * | 2/1951 | Hammond | 2/82 |
| 2,670,471 | A * | 3/1954 | Kaufman | 2/80 |
| 3,671,975 | A * | 6/1972 | Vorsteher | 2/232 |
| 3,742,518 | A * | 7/1973 | Garcia | 2/79 |
| 4,114,200 | A * | 9/1978 | Smith et al. | 2/51 |
| 4,389,734 | A * | 6/1983 | Franz et al. | 2/59 |
| 4,543,670 | A * | 10/1985 | Ehring | 2/85 |
| 4,631,753 | A * | 12/1986 | Ehring | 2/85 |
| 4,733,412 | A * | 3/1988 | Campbell | 2/161.1 |
| 4,752,972 | A * | 6/1988 | Neckerman et al. | 2/123 |
| 5,001,785 | A * | 3/1991 | Heiman et al. | 2/123 |
| 5,044,015 | A * | 9/1991 | Howard | 2/269 |
| 5,073,988 | A * | 12/1991 | Lewis et al. | 2/162 |
| 5,138,717 | A * | 8/1992 | Tolton | 2/123 |
| 5,208,919 | A * | 5/1993 | Fields | 2/123 |
| 5,218,720 | A * | 6/1993 | Tolton | 2/97 |
| 5,359,735 | A * | 11/1994 | Stockwell | 2/243.1 |
| 5,388,270 | A * | 2/1995 | Hewitt | 2/93 |
| 5,444,871 | A * | 8/1995 | Lopez | 2/114 |
| 5,461,724 | A * | 10/1995 | Wiedner et al. | 2/457 |
| 5,572,743 | A * | 11/1996 | Yavitz | 2/125 |
| 5,673,433 | A * | 10/1997 | Rothrum | 2/46 |
| 5,794,265 | A * | 8/1998 | Reich | 2/125 |
| 5,813,052 | A * | 9/1998 | Taylor | 2/114 |
| 6,235,659 | B1 * | 5/2001 | McAmish et al. | 442/79 |
| 6,665,880 | B2 * | 12/2003 | Poppe | 2/114 |
| 2003/0079272 | A1 * | 5/2003 | Poppe | 2/114 |
| 2004/0006815 | A1 * | 1/2004 | Carroll et al. | 2/457 |
| 2006/0096003 | A1 * | 5/2006 | Plaatje et al. | 2/114 |

* cited by examiner

*Primary Examiner*—Gary L. Welch
*Assistant Examiner*—Jena A Sold
(74) *Attorney, Agent, or Firm*—Raymond Y. Chan; David and Raymond Patent Firm

(57) ABSTRACT

A sanitary arm sleeve structure includes an arm sleeve, adapted for receiving the user's arm therewithin, having an outer side, an opposed inner side, and a free edge end, and a sleeve protection layer having an upper edge end attached on the arm sleeve and a lower edge end extended to the free edge end of the arm sleeve so as to overlappedly encircle the sleeve protection layer around the outer side of the arm sleeve. An elastic retaining loop is provided at the inner side of the arm sleeve above the free edge end thereof for applying an elastic binding force around the user's arm above the wrist thereof, so as to retain the arm sleeve in position that the sleeve protection layer is capable of encircling around the user's arm.

6 Claims, 4 Drawing Sheets

SANITARY ARM SLEEVE STRUCTURE

BACKGROUND OF THE PRESENT INVENTION

1. Field of Invention

The present invention relates to an arm sleeve, and more particularly to a sanitary arm sleeve structure for use in the clinical profession or with treatment of animals for various industries or for veterinarian use, so that it provides a cleanable protective layer at a lower arm portion of the arm sleeve so as to prevent bacteria penetration, dirt or blood or body fluid entry through the arm sleeve.

2. Description of Related Arts

During a physical check up or surgery, doctors or nurses and any health providers that are in contact with patients or animals are required to wear surgery or exam gloves and clinic coats and scrubs to prevent body contamination. The surgeon's glove, which is made of plastic, latex or nitrile, etc., is disposable such that the physician is able to throw away the glove after every medical procedure to prevent contamination of the care provider or the other patients or animals. However, body fluids, blood or human and animal excrements may accidentally be coated onto the sleeve of the clinic coat in that healthcare setting and be transfer from one area to another. There are disposable scrubs currently on the market these days but it is costly and wasteful that all clinic coats and scrubs be made of disposable material to prevent bacteria and dirt contamination. The majority of protective clothing for healthcare providers is not disposable to this day.

Generally, health providers must wash their non-disposable clinic coats and scrubs after every surgery or daily for hygienic purposes; however, body fluids or blood from the patient/animal may get onto the coat sleeve and/or the shirt sleeve of the doctor during treatment. Therefore, the healthcare provider is unsanitary because the shirt sleeve and scrub is coated with contaminants. The doctor also has the above problem that the body fluids or blood from the patient/animal may contact directly onto the bare arm of the doctor through the opening of the sleeve during treatment. Likewise, any watches or wrist jewelry may also be contaminated. Since hundreds of patients and animals may visit the health provider every day, the contaminants coated at the sleeve and/or the arm may easily pass from the previous patient/animal to other patients or animals.

For hygiene purposes, the healthcare provider may certainly wear a sleeve protection at the lower arm portion to be protected from any infection from the patient/animal. Accordingly, the sleeve protection, which is made from washable material, has two elastic ends wherein when the arm of the user is inserted into the sleeve protection, the two elastic ends wherein when the arm of the user is inserted into the sleeve protection, the two elastic ends of the sleeve protection bind around the user's arm below the elbow and above the wrist respectively so as to retain the sleeve protection at the lower arm of the user. Such conventional sleeve protection can prevent the contaminants from coating on the sleeve; however, the sleeve protection has several drawbacks.

Since the two elastic ends of the sleeve protection must be securely bound at the elbow and the wrist of the arm respectively, the movement of the arm is restricted by the elastic ends of the sleeve protection. Also, different people have different arm and wrist sizes so the elastic may be too tight or too loose. Doctors require precise arm movements during surgery or diagnosis. In addition, when the doctor stretches his or her arm, the elastic ends of the sleeve protection may be forced to slide along the arm, such that the doctor must constantly adjust the position of each of the elastic ends of the sleeve protection. It is also a hassle to wear the sleeve protection device because the doctor must put the sleeve protection onto the outer side of the sleeve of the coat, which will destroy the professional appearance of the doctor. Therefore, the sleeve protection has disadvantages in practical use.

Current coats and scrubs may have a cotton covered elastic band at the end of the coat sleeve to bind the wrist to act as a barrier, but the elastic band has a cotton covering which is very absorbent to bacteria and liquid contaminants as it is porous and can transfer contaminants from one area of the health facility to the next. When doctors, veterinarians, and nurses put their arms on various surfaces to work and write, they can pick up contaminants and transfer them to other areas and to other patients with their contaminated arm sleeve and wrist band.

SUMMARY OF THE PRESENT INVENTION

A main objective of the present invention is to provide a sanitary arm sleeve structure for use in the healthcare setting, which provides a cleanable protective layer at a lower arm portion of the arm sleeve so as to prevent bacteria and dirt entry through the arm sleeve.

Another objective of the present invention is to provide a sanitary arm sleeve structure which comprises a sleeve protection layer integrally and overlapped at the outer side of the arm sleeve, so as to prevent contaminants getting onto the arm sleeve of the clinic coat.

Another objective of the present invention is to provide a sanitary arm sleeve structure which comprises an elastic retaining loop for applying an elastic binding force around the wrist of the user so as to retain the sleeve protection layer in position with respect to the user's arm. In other words, the sleeve protection layer will retain at its position even though the user stretches his or her arm.

Another objective of the present invention is to provide a sanitary arm sleeve structure, wherein the retaining loop made of silicone is positioned at an inner side of the arm sleeve to bind above the wrist of the user. Therefore, the retaining loop is hidden inside the arm sleeve to keep the professional appearance of the arm sleeve. Since the material is silicone, this sanitary arm sleeve will not be liquid and bacteria absorbent compared to what is currently used and this sanitary arm sleeve can be easily sprayed with disinfectant at any time and wiped between patients or animal visits by the healthcare provider.

Another objective of the present invention is to provide a sanitary arm sleeve structure, which does not require altering the original structure of the arm sleeve so as to minimize the manufacturing cost of the arm sleeve.

Another objective of the present invention is to provide a sanitary arm sleeve structure, which is easy to use by simply inserting the user's arm into the arm sleeve.

Accordingly, in order to accomplish the above objectives, the present invention provides a sanitary arm sleeve structure for a user's arm to insert into, comprising:

an arm sleeve, adapted for receiving the user's arm, having an outer side, an opposed inner side, and a free edge end;

a sleeve protection layer having an upper edge end attached on the arm near the elbow of the coat, and a lower edge end extended to the free edge end of the arm sleeve so as to overlap and encircle the sleeve protection layer around the outer side of the arm sleeve and;

an elastic retaining loop formed at the inner side of the arm sleeve slightly further up the arm away from the free edge end for applying an elastic binding force around the user's wrist, so as to retain the arm sleeve in position so that the sleeve protection layer is capable of encircling around the user's arm near the wrist.

These and other objectives, features, and advantages of the present invention will become apparent from the following detailed description, the accompanying drawings, and the appended claims.

DETAILED DESCRIPTION OF THE PREFERRED EMBODIMENT

Figure 1:
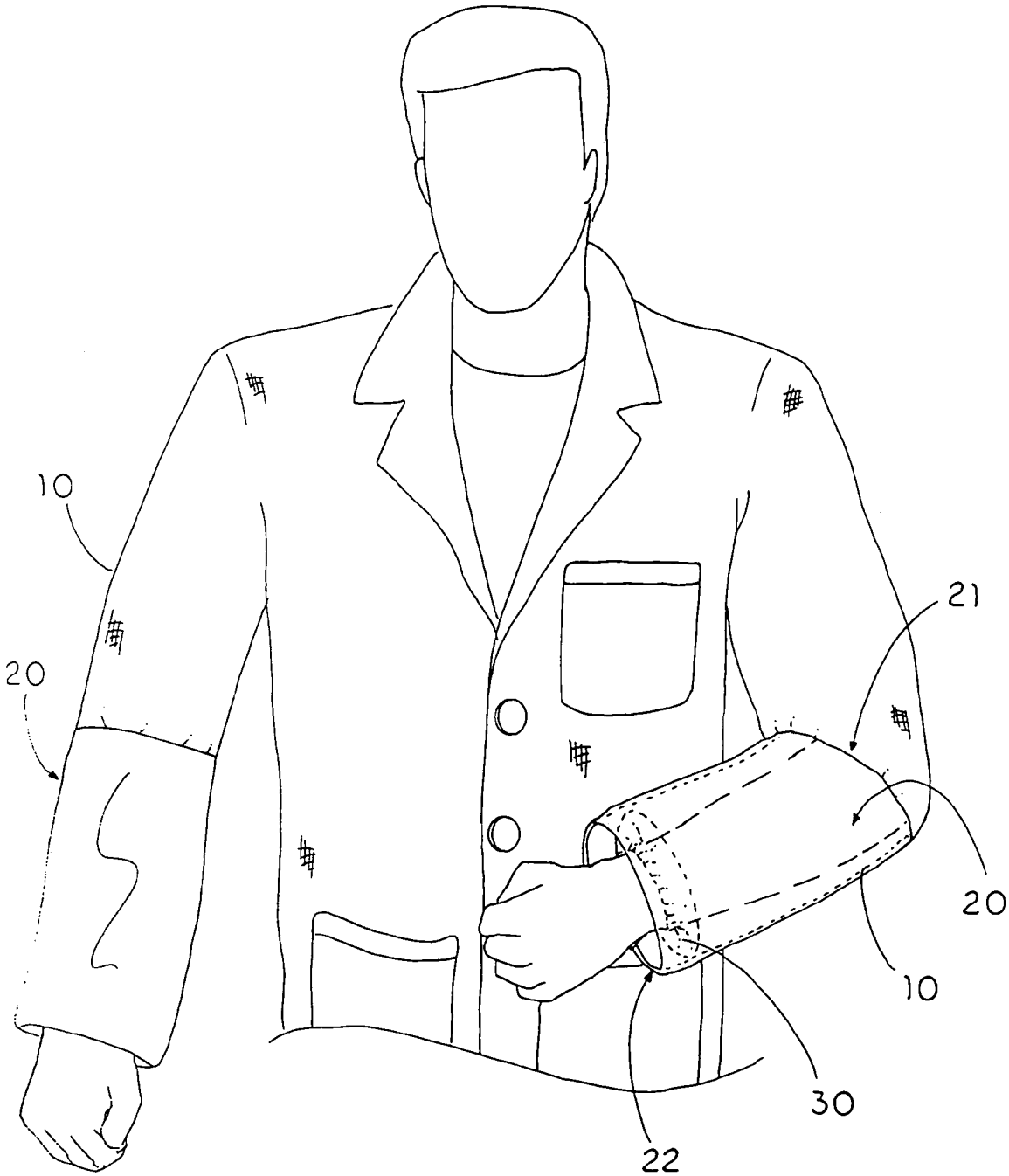
FIG. 1 is a perspective view of a sanitary arm sleeve structure according to a preferred embodiment of the present invention, illustrating the sanitary arm sleeve structure designed for lab coat.
Figure 2:
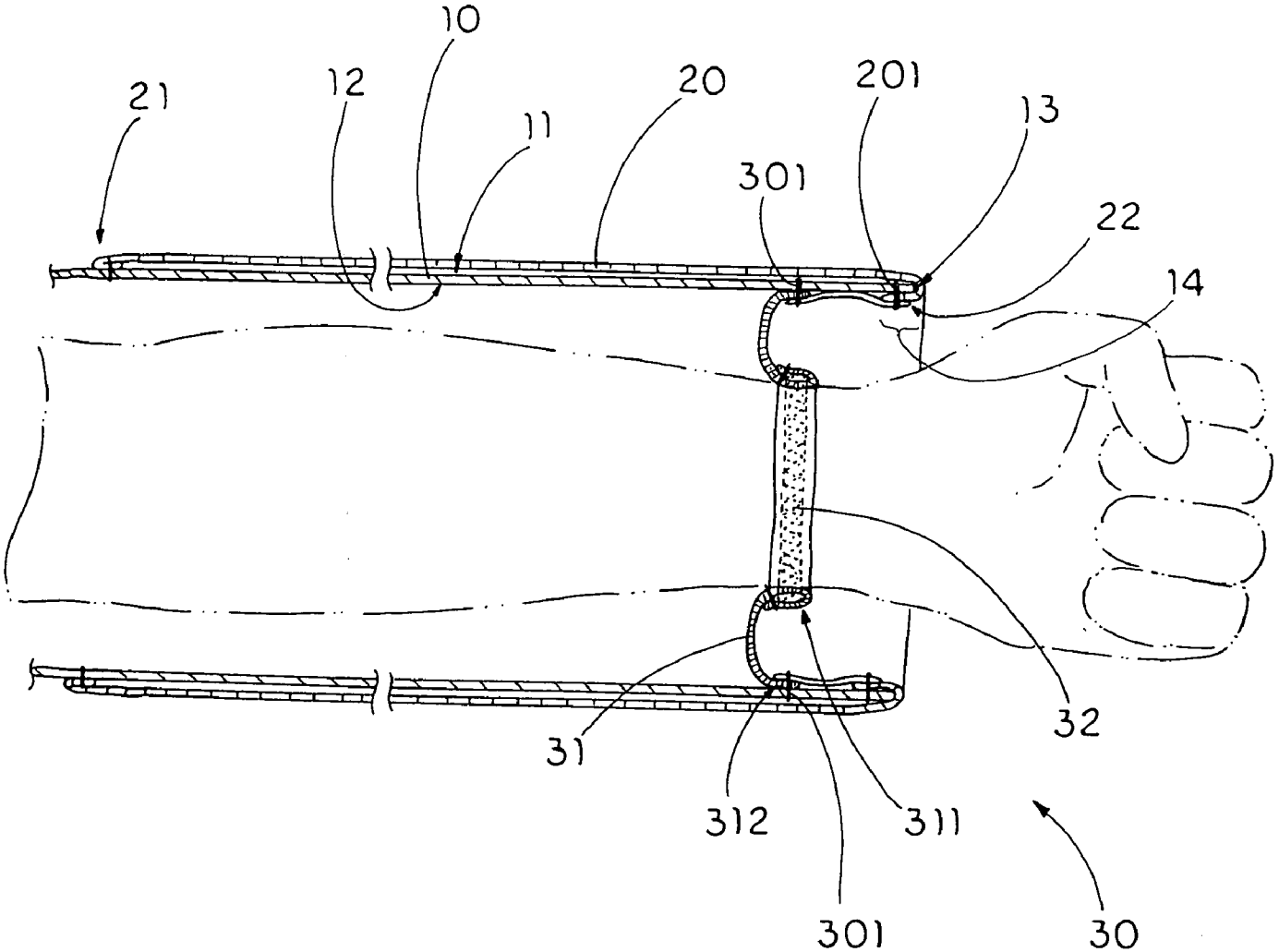
FIG. 2 is a sectional view of the sanitary arm sleeve structure according to the above preferred embodiment of the present invention.

Referring to FIGS. 1 and 2 of the drawings, a sanitary arm sleeve structure utilized with a lab coat according to a preferred embodiment of the present invention is illustrated, wherein the sanitary arm sleeve structure comprises an arm sleeve 10, adapted for receiving the user's arm therewithin, having an outer side 11, an opposed inner side 12, and a free edge end 13.

The sanitary arm sleeve structure further comprises a sleeve protection layer 20 having an upper edge end 21 attached on the arm sleeve 10 and a lower edge end 22 extended to the free edge end 13 of the arm sleeve 10 so as to overlappedly encircle the sleeve protection layer 20 around the outer side 11 of the arm sleeve 10, and an elastic retaining loop 30 formed at the inner side 12 of the arm sleeve 10 above the free edge end 13 thereof for applying an elastic binding force around the user's arm above the wrist thereof, so as to retain the arm sleeve 10 in position so that the sleeve protection layer 20 is capable of encircling around the user's arm.

Figure 4:
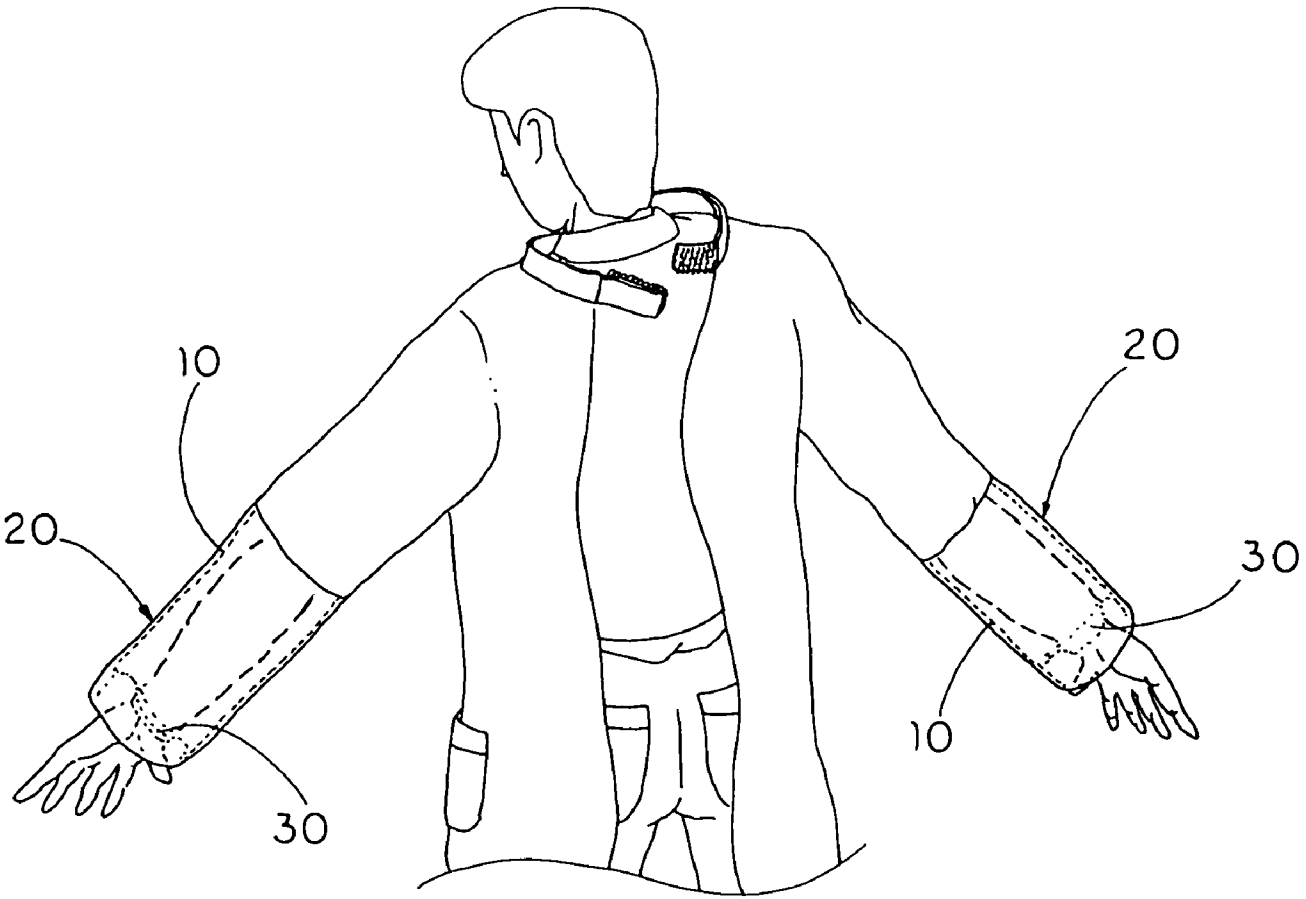
FIG. 4 illustrates the sanitary arm sleeve structure utilized with a surgeon coat according to the above preferred embodiment of the present invention.

According to the preferred embodiment, when the user, such as a physician, wear the lab coat, the arm of the user inserts into the arm sleeve 10 that the free edge end 13 of the arm sleeve 10 is positioned below the wrist of the user's arm such that the arm sleeve 10 is arranged to encircle around the user's arm to prevent body contamination. Alternatively, the sanitary arm sleeve structure can be utilized with a surgeon coat, as shown in FIG. 4. The arm sleeve 10, which is made of fabric material such as cotton, is embodied as a part of the lab coat that the arm sleeve 10 is extended from a coat body.

The sleeve protection layer 20 has a tubular shape that overlaps and covers on the outer side 11 of the arm sleeve 10 at a lower portion thereof wherein the upper edge end 21 of the sleeve protection layer 20 is securely attached on the arm sleeve 10 at a position below an elbow of the user's arm. The sleeve protection layer 20 is preferably made of silicone rubber having anti-adhesive properties, low chemical reactivity and low toxicity. In addition, the silicone rubber made sleeve protective layer 20 can be cleanable which is capable of substantially preventing the contaminates coating thereon.

Accordingly, the upper edge end 21 of the sleeve protection layer 20 is attached to the outer side 11 of the arm sleeve 10 by ultrasonic welding or sewing to substantially overlap the sleeve protection layer 20 on the outer side 11 of the arm sleeve 10.

As shown in FIG. 2, the lower edge end 22 of the sleeve protection layer 20 is inwardly folded to overlap on the inner side 12 of the arm sleeve 10 along the free edge end 13 thereof, wherein at least one line of attaching spots 201 is continuously aligned along the free edge end 13 of the arm sleeve 10 at the inner side 12 thereof to securely attach the lower edge end 22 of the sleeve protection layer 20 to the inner side 12 of the arm sleeve 10 such that the lower edge end 22 of the sleeve protection layer 20 is protectively encircling around the free edge end 13 of the arm sleeve 10. Accordingly, the line of attaching spots 201 can be embodied as a line of sewing spots or a line of ultrasonic welding spots.

The retaining loop 30 comprises a blocking strap 31 having an inner edge 311 and an outer edge 312 extended from the inner side 12 of the arm sleeve 10 at an edge portion 14 thereof, and a circular elastic element 32 provided around the inner edge 311 of the blocking strap 31 for providing the elastic binding force at the user's arm, wherein a diameter of the inner edge 311 of the blocking strap 31 is smaller than that of the arm sleeve 10, such that when the elastic element 31 binds around the user's arm, the blocking strap 31 functions as a barrier for preventing an unwanted material, such as body fluid or blood, entering into the arm sleeve 10.

The blocking strap 31, which is also made of silicone rubber, has a circular shape defining the inner edge 311 forming as a pocket to receive the elastic element 32 therearound. The retaining loop 30 further comprises at least one line of affixing spots 301 continuously aligned along a length of the outer edge 312 of the blocking strap 31 so as to securely attach the blocking strap 31 on the inner side 12 of the arm sleeve 10. Accordingly, the line of affixing spots 301 can be embodied as a line of sewing spots or a line of ultrasonic welding spots.

The elastic element 32, according to the preferred embodiment, is an elastic band securely provided around the inner edge 311 of the blocking strap 31 for binding around the user's arm at a position above the wrist thereof. As shown in FIG. 2, a width of the edge portion 14 of the arm sleeve 10 is longer than a width of the blocking strap 31 such that the elastic element 32 is positioned within the arm sleeve 10 so as to keep the professional appearance of the lab coat. It is worth to mention that even the user stretch his or her arm, the elastic element 32 will remain inside the arm sleeve 10 so as to prevent the retaining loop 30 accidentally sliding out of the arm sleeve 10.

Figure 3:
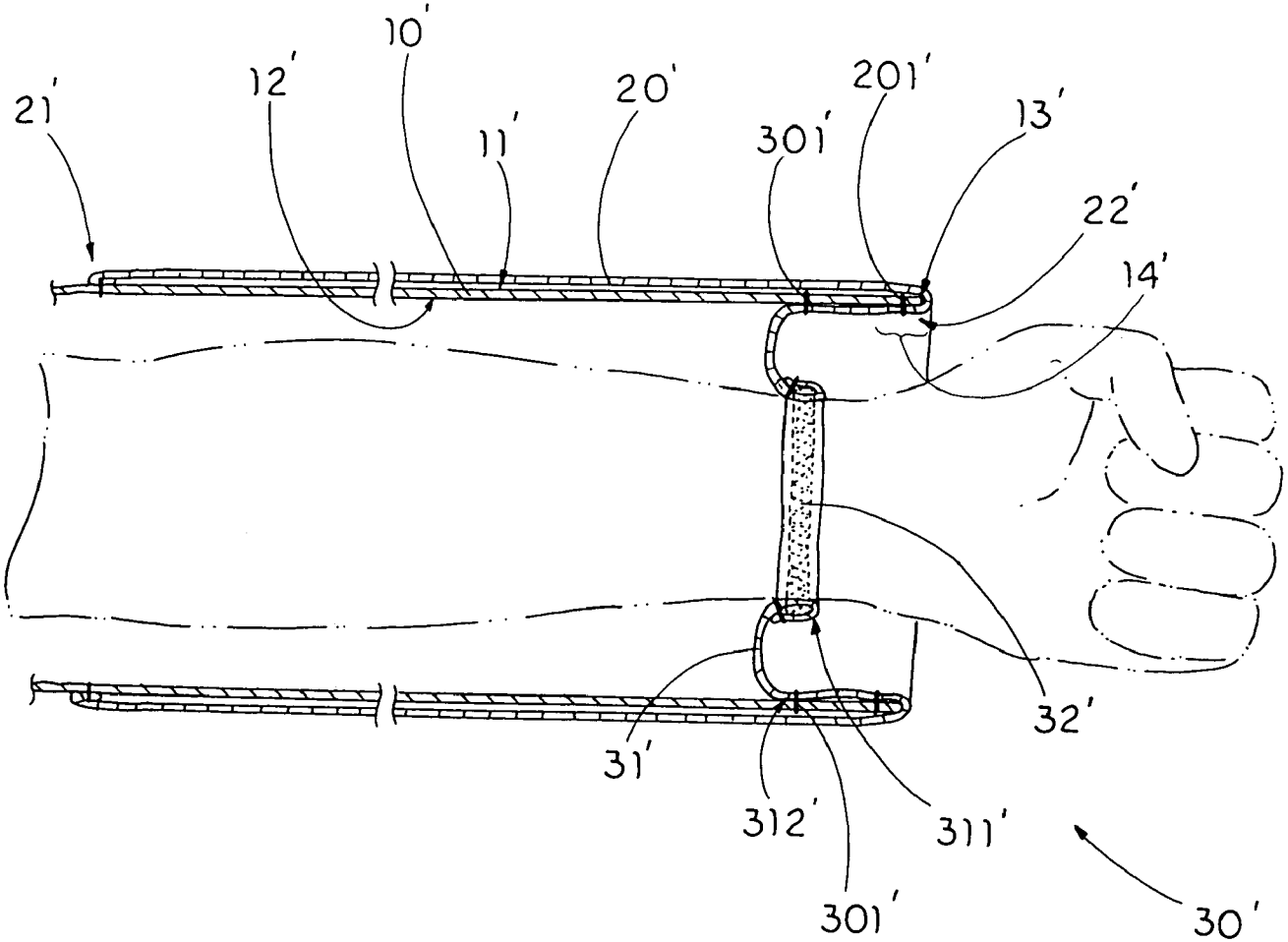
FIG. 3 illustrates an alternative mode of the sanitary arm sleeve structure according to the above preferred embodiment of the present invention.

FIG. 3 illustrates an alternative mode of the sanitary arm sleeve structure wherein the arm sleeve 10' has an outer side 11', an opposed inner side 12', and a free edge end 13'.

The sleeve protection layer 20' has an upper edge end 21' attached on the arm sleeve 10' and a lower edge end 22' extended to the free edge end 13' of the arm sleeve 10' so as to overlappedly encircle the sleeve protection layer 20' around the outer side 11' of the arm sleeve 10'.

The upper edge end 21' of the sleeve protection layer 20' is attached to the outer side 11' of the arm sleeve 10' by ultrasonic welding or sewing to substantially overlap the sleeve protection layer 20' on the outer side 11' of the arm sleeve 10'. The lower edge end 22' of the sleeve protection layer 20' is inwardly folded to overlap on the inner side 12' of the arm sleeve 10' along the free edge end 13' thereof.

The retaining loop 30' comprises a blocking strap 31' having an inner edge 311' and an outer edge 312' extended from the inner side 12' of the arm sleeve 10' at an edge portion 14' thereof, and a circular elastic element 32' provided around the inner edge 311' of the blocking strap 31' for providing the elastic binding force at the user's arm.

As shown in FIG. 3, the outer edge 312' of the blocking strap 31' is integrally extended from the lower edge end 22' of the sleeve protection layer 20', wherein at least one line of affixing spots 301' continuously aligned along a length of the outer edge 312' of the blocking strap 31' so as to securely attach the blocking strap 31' on the inner side 12' of the arm sleeve 10'. A width of the edge portion 14' of the arm sleeve 10' is longer than a width of the blocking strap 31' such that the elastic element 32' will remain inside the arm sleeve 10' so as to prevent the retaining loop 30' accidentally sliding out of the arm sleeve 10'.

It is worth to mention that the line of affixing spots 301' not only securely affixes the blocking strap 31' on the inner side 12' of the arm sleeve 10' but also firmly attaches the sleeve protection layer 20' on the outer side 11' of the arm sleeve 10'. In order to further securely retain the sleeve protection layer 20' in position, at least one line of attaching spots 201' is continuously aligned along the free edge end 13' of the arm sleeve 10' at the inner side 12' thereof so as to securely overlap the sleeve protection layer 20' on the outer side 11' of the arm sleeve 10'.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sanitary arm sleeve structure for an arm of a user inserting thereinto, comprising:

a fabric made arm sleeve, adapted for receiving said user's arm therewithin, having an outer side, an opposed inner side, and a free edge defining an edge portion thereat;

a sleeve protection layer, which is overlapped on and encircled with said arm sleeve, having an upper edge attached to an outer side of said arm sleeve at a position below an elbow of the user's arm, a lower edge which is extended to said free edge of said arm sleeve to inwardly fold into said arm sleeve and is attached to said inner side of said arm sleeve to encirclingly enclose said edge portion of said arm sleeve within said sleeve protection layer; and an elastic retaining loop comprising a blocking strap having an inner edge and an outer edge extended from said inner side of said arm sleeve at said edge portion thereof, and a circular elastic element provided around said inner edge of said blocking strap within said arm sleeve for applying an elastic binding force around said user's arm above a wrist thereof, so as to retain said arm sleeve in position that said sleeve protection layer is capable of encircling around said user's arm, wherein said outer edge of said blocking strap is integrally extended from said lower edge of said arm sleeve protection layer such that said lower edge is inwardly folded to overlap on said inner side of said arm sleeve to form the entire blocking strap and to enclose said edge portion of said arm sleeve.

2. The sanitary arm sleeve structure, as recited in claim 1, wherein said sleeve protection layer and said blocking strap are made of silicone rubber.

3. The sanitary arm sleeve structure, as recited in claim 2, wherein said inner edge of said blocking strap is folded to form a pocket to receive said elastic element therein so as to retain said elastic element around said inner edge of said blocking strap.

4. The sanitary arm sleeve structure, as recited in claim 3, wherein said retaining loop further comprises at least one line of affixing spots continuously aligned along a length of said outer edge of said blocking strap so as to securely attach said blocking strap on said inner side of said arm sleeve.

5. The sanitary arm sleeve structure, as recited in claim 2, wherein said retaining loop further comprises at least one line of affixing spots continuously aligned along a length of said outer edge of said blocking strap so as to securely attach said blocking strap on said inner side of said arm sleeve.

6. The sanitary arm sleeve structure, as recited in claim 1, wherein said inner edge of said blocking strap is folded to form a pocket to receive said elastic element therein so as to retain said elastic element around said inner edge of said blocking strap.

* * * * *